US007275643B2

(12) United States Patent
Rautiola

(10) Patent No.: US 7,275,643 B2
(45) Date of Patent: Oct. 2, 2007

(54) ENVIRONMENTALLY SAFE PROMOTER FOR USE IN FLOTATION SEPARATION OF CARBONATES FROM MINERALS

(75) Inventor: Craig W. Rautiola, Traverse City, MI (US)

(73) Assignee: Fairmount Minerals, Inc., Chardon, OH (US)

( * ) Notice: Subject to any disclaimer, the term of this patent is extended or adjusted under 35 U.S.C. 154(b) by 30 days.

(21) Appl. No.: 11/203,919

(22) Filed: Aug. 15, 2005

(65) Prior Publication Data

US 2006/0037890 A1 Feb. 23, 2006

Related U.S. Application Data

(60) Provisional application No. 60/602,034, filed on Aug. 17, 2004.

(51) Int. Cl.
*B03D 1/008* (2006.01)
*B03D 1/018* (2006.01)

(52) U.S. Cl. ..... 209/166; 252/61

(58) Field of Classification Search ..... 209/166, 209/167; 252/60, 61
See application file for complete search history.

(56) References Cited

U.S. PATENT DOCUMENTS

| | | | | |
|---|---|---|---|---|
| 1,992,949 | A * | 3/1935 | Hodges | 252/61 |
| 4,066,588 | A * | 1/1978 | Funabiki et al. | 523/142 |
| 4,090,972 | A | 5/1978 | Wang et al. | |
| 4,276,156 | A | 6/1981 | Hefner, Jr. | |
| 4,301,004 | A | 11/1981 | Hefner, Jr. | |
| 4,585,550 | A | 4/1986 | Avotins et al. | |

* cited by examiner

*Primary Examiner*—Thomas M. Lithgow
(74) *Attorney, Agent, or Firm*—C. W. Alworth

(57) ABSTRACT

An environmentally safe composition of matter for use as a promoter chemical in flotation separation of carbonates from industrial sand is disclosed. The promoter chemical replaces the standard petroleum sulfonate, glycol ether and nonphenol used in promoter chemicals with biodegradable substitutes permitting the waste from flotation separation to be disposed without fear of contamination of ground water. The biodegradable promoter is technically sound and causes little change to the flotation process.

5 Claims, 2 Drawing Sheets

W450H WASH PLANT INFORMATION

| Oper | Test | Date | Time | Chemical | Chm. Rat | Prd Rat | adv Tar | adv | G.F.N. | Clay | L.O.I. | P.H |
|---|---|---|---|---|---|---|---|---|---|---|---|---|
| Ricky | 256 | 10/9/03 | 5 P.M. | | 400 | 335 | 10.5 | 16.8 | 46.61 | | | |
| | 257 | 10/9/03 | 7 P.M | | 425 | 335 | 10.5 | 18.7 | 49.01 | 0.16 | 0.4 | 8.01 |
| | 258 | 10/9/03 | 9 P.M. | | 800 | 335 | 10.5 | 10.6 | 48.65 | | | |
| | 259 | 10/9/03 | 11 P.M. | | 800 | 335 | 10.5 | 11.8 | 52.43 | | | |
| Randy | 260 | 10/10/03 | 1 A.M. | | 800 | 335 | 10.5 | 13 | 48.43 | | | |
| | 261 | 10/10/03 | 3 A.M. | | 825 | 335 | 10.5 | 9.5 | 48.32 | 0.18 | 0.22 | 7.96 |
| | 262 | 10/10/03 | 4 A.M. | | 825 | 335 | 10.5 | 7.7 | 46.5 | | | |
| | 263 | 10/10/03 | 5 A.M. | 2194 | 750 | 335 | 10.5 | 9.3 | 48.02 | | | |
| | 264 | 10/10/03 | 6 A.M. | 2194 | 750 | 335 | 10.5 | 8 | 47.96 | | | |
| Vince | 265 | 10/10/03 | 8 A.M. | 2194 | 700 | 335 | 10.5 | 8.3 | 44.63 | | | |
| | 266 | 10/10/03 | 10 A.M. | 2194 | 650 | 335 | 10.5 | 8.8 | 47.82 | 0.18 | 0.22 | 8.23 |
| | 267 | 10/10/03 | 1 P.M. | 2194 | 550 | 335 | 10.5 | 10.1 | 47.96 | | | |
| Ricky | 268 | 10/10/03 | 5 P.M. | 2194 | 450 | 335 | 10.5 | 12.6 | 48.89 | | | |
| | 269 | 10/10/03 | 7 P.M | 2194 | 475 | 335 | 10.5 | 13.2 | 49.3 | 0.16 | 0.34 | 8.23 |
| | 270 | 10/10/03 | 9 P.M. | 2194 | 550 | 335 | 10.5 | 10.7 | 49.32 | | | |
| | 271 | 10/10/03 | 11 P.M. | 2194 | 550 | 335 | 10.5 | 9.8 | 49.91 | | | |
| Randy | 272 | 10/13/03 | 1 A.M. | 2194 | 550 | 335 | 10.5 | 9.1 | 50.93 | 0.2 | 0.3 | |
| Randy | 273 | 10/27/03 | 2 A.M. | | 750 | 330 | 10.5 | 8 | 50.03 | | | |
| | 274 | 10/27/03 | 4 A.M. | | 600 | 330 | 10.5 | 7.7 | 50.15 | 0.28 | 0.26 | |
| | 275 | 10/27/03 | 6 A.M. | | 400 | 330 | 10.5 | 10.5 | 51.3 | | | |
| Vince | 276 | 10/27/03 | 8 A.M. | | 400 | 330 | 10.5 | 9.2 | 52.78 | | | |
| | 277 | 10/27/03 | 10 A.M. | | 400 | 330 | 10.5 | 10.4 | 47.36 | 0.2 | 0.3 | |
| | 278 | 10/27/03 | 12 P.M. | | 400 | 330 | 10.5 | 11.1 | 47.03 | | | |
| | 279 | 10/27/03 | 2 P.M. | | 400 | 330 | 10.5 | 11.2 | 48.17 | | | |

Figure 2

ENVIRONMENTALLY SAFE PROMOTER FOR USE IN FLOTATION SEPARATION OF CARBONATES FROM MINERALS

This application claims the benefit of priority stemming U.S. Provisional Application 60/602,034 filed on Aug. 17, 2004.

The present invention relates generally to the process for beneficiating minerals by froth flotation. More particularly, it relates to such a process wherein selected compositions for the principal collector combined with frother, modifier and/or surfactant, generally called a promoter chemical, produce an environmentally friendlier composition of matter that is biodegradable and provides good performance in the production of minerals.

BACKGROUND OF THE INVENTION

Froth flotation is a mineral processing technique for either concentrating a valuable mineral or removing an unwanted mineral. Its chief advantage lies in the fact that it is a relatively efficient process operating at substantially lower costs than many other mineral beneficiation processes.

In general terms, flotation begins with the addition of a collector chemical to a mineral slurry in a process called conditioning. Conditioning is a high shear blending of the collector chemical throughout typical high solids mineral slurry (typical 70% by weight). Properly chosen, the collector chemical coats the surface of some minerals with a greater affinity than others. Once conditioned, the mineral slurry is then diluted (typical 35% solids), and a frothing chemical is added. The frother chemical increases the surface tension (bubble strength) of air bubbles in solution. The slurry is then introduced into flotation cells. Air is introduced and dispersed throughout the slurry. As the individual air bubbles travel to the surface of the flotation cells, they selectively attach to the collector chemical and associated mineral. The froth formed at the surface of the flotation cell is quickly removed, effectively removing a selective mineral captured within the froth.

In purifying industrial sand, the assignee has historically ordered a custom blend chemical with the collectors and frothers premixed. A common term for describing this premixed chemical is to call it a "Promoter Chemical". The promoter chemical has typically been a combination of four components as follows: (1) Tall Oil/Fatty Acid (TOFA) with a 2%-15% rosin acid content, (2) Petroleum sulfonate; natural and synthetic, (3) Polypropylene glycol monobutyl ether frother, and (4) nonphenol a coupling agent. Petroleum sulfonate, nonphenol and glycol chemicals have become "issues of concern" from a groundwater regulation standpoint. TOFA is an organic product (C18 group) and is a byproduct of the paper industry produced by concentrating the fluid in a distillation process. The rosin content is directly contributed by pine trees and varies with the specification of TOFA and may be varied in the distillation process. The lower the content of rosin, the higher the price.

Thus, the need arises to discover a new promoter chemical that is effective in removing carbonate impurities from industrial sand, while resulting in less negative impact on the environment.

SUMMARY OF THE INVENTION

The invention consists of replacing the petroleum sulfonate, the nonphenol and the glycol ether in the commercial mixtures with a biodegradable equivalent that meets or exceeds the performance qualities of the non-degradable chemical thereby creating a new compound of matter. The new blend comprises Tall Oil/Fatty Acid, mixed with Linseed Oil and if necessary Alcohol, wherein the linseed oil acts as the modifier to the TOFA and the alcohol acts as the frother. Two slightly different blends are preferably used wherein the blend is sensitized for the specific sand. In addition sodium silicate may be added to suppress the flotation of silica.

BRIEF DESCRIPTION OF THE DRAWINGS

FIG. 2 is a table taken from operating data, showing Acid Demand Values (ADV) for sand production one day before testing, the day of testing and one day after testing. The compound 2194 is the TOFA (90%): Linseed Oil (10%) embodiment of composition of matter of the instant invention.

DETAILED DESCRIPTION OF THE EMBODIMENT

Figure 1:
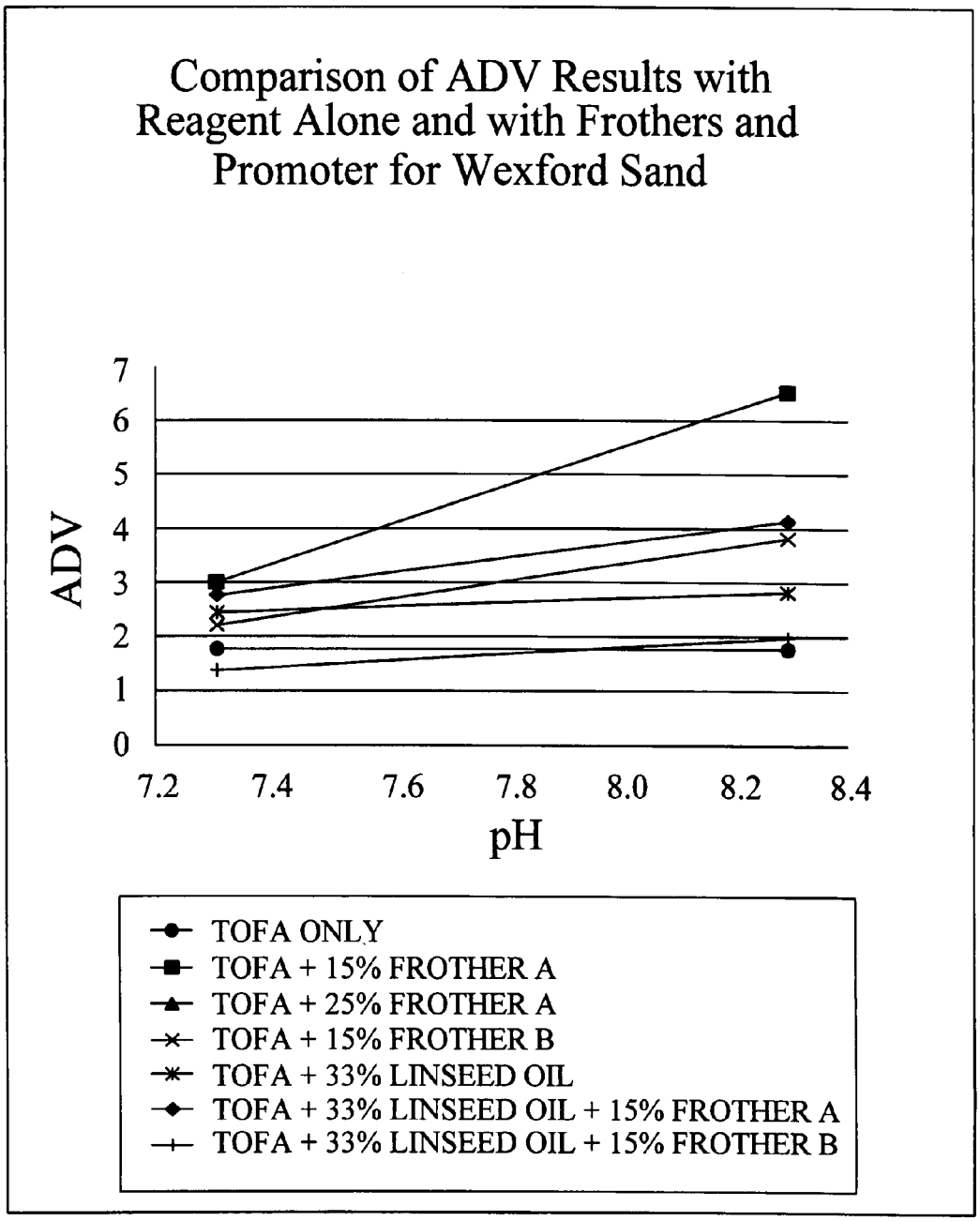
FIG. 1 is a chart showing laboratory results comparing various collector/promoters with the invention.

The inventor looked at the proprietary promoter mix: a well known blend of Tall Oil/Fatty Acid (TOFA) as the collector using a modifier and frother. In the particular process operated by the assignee, two blends of promoter are used which are set by the grade/type of industrial sand required and/or being manufactured. Essentially the TOFA ratio is varied such that the rosin varies between less than two per cent and approximately 15 per cent. The actual quantity of blended TOFA is relatively constant in the final composition of matter.

The collector TOFA causes little groundwater concern for a disposal operation. The concern is over the petroleum sulfonate (a modifier) and glycol ether (the frother). The inventor started by deciding on biodegradable substitute for the modifier and frother. Based on a comparison of the chemical structure of glycol ether with alcohol it was decided that common 2-ethyl hexyl could possibly replace the glycol. Tests were conducted using TOFA, petroleum sulfonate and 2-ethyl hexyl. It was found that the composition did indeed perform as expected. All that remained was to find a suitable substitute for the petroleum sulfonate.

The inventor then concentrated on a replacement for the petroleum sulfonate with an organic chemical—preferably degradable. The inventor eventually chose plain linseed oil for testing. Linseed oil was chosen because:

1) it is falls within the fatty acid group although it differs from TOFA, 2) it is biodegradable, and 3) it has a similar viscosity and specific gravity to the other TOFA chemicals previously used (thus it should blend and minimize stratification).

A series of laboratory tests was then conducted and it was found that the mixture immediately gave optimistic results. The laboratory results are shown in the graph of FIG. 1.

The industry uses a back-door standard to obtain a quality number for the amount of carbonates remaining in the sand. A given quantity of Hydrochloric Acid is added to a given quantity of sand ('the sample') and deionized water. The mixture stirred for given number of minutes. The Hydrochloric Acid (HCl) will react with any carbonates in the sample thereby reducing the "free" HCl. At the end of the test time (about 5 minutes), Sodium Hydroxide (NaOH) is titrated to take the mixture to 7.0 Ph. The amount of NaOH needed to neutralize the mixture is called the ADV. In the foundry industry some carbonates are tolerated and the maximum ADV value is 14 or less.

As can be seen in the graph TOFA and 33% linseed oil gave an ADV value of less than 3. TOFA only gave a value between 3 and 5, and mix of TOFA, 15% Frother and 33% linseed oil produced the best result of 1.5. The laboratory graph is actually based on the slurry mix water at the facility (not deionized water) and varies between 7.2 and 8.4 Ph depending on the time of year. The results proved that a pure TOFA and Linseed Oil mix was viable. A frother can further improve performance.

Field testing followed and confirmed the laboratory findings. At the assignee's sand plant in Harrietta, Mich., the standard promoter chemical (using TOFA, Petroleum Sulfonate, nonphenol and Glycol) was switched to a 90% TOFA and 10% linseed oil. For the next 20 hours production samples were taken and ADV tests performed. The results are shown in the table of FIG. 2. As can be seen the results were very acceptable with the ADV value being recorded varying between 8 and 13.2 (below the specification limit of 14.0). During the five days prior to the test and for one day after the test the ADV values, using standard chemicals ranged from as high as 18.7 to low as 7.6. Thus, the field test showed that the new composition would perform well.

To prove that the plant test was not biased, a sample of the new collector was sent to a competitor and tests were conducted over a three day period in the fall of 2004. The tests initially focused on determining the correct dosage rate for the new "reagent" and the "existing" reagent. The term reagent is used to mean the instant promoter of this invention. After a day, testing showed that reagent injection could be substantially lowered over the previous regents while obtaining excellent ADV results. The ADV actually ranged between 2.1 and 6.4: even better than the test results reported above at the Harrietta mine.

As stated earlier, different sands will vary as to the quantity of new composition that will be required to separate carbonates from the sand. It is believed that cost savings associated with waste disposal (the environmentally friendly material) will be greater that the additional cost of the composition.

It was found that that the composition of matter must be "sensitized" for the specific sand and at the particular Harrietta production facility two "blends" were found to perform well Blend 1:

85%-90% Tall Oil/Fatty Acid (0%-5% Rosin Acid)

5%-10% Linseed Oil

5% Alcohol (2-ethylhexane)

Blend 2:

85%-90% Tall Oil/Fatty Acid (2-15% Rosin Acid)

5%-10% Linseed Oil

5% Alcohol (2-ethylhexane)

The inventor added sodium silicate to the compound to suppress the flotation of silica.

In summary, what is claimed is a new composition of matter that has been designed from the outset to be first and foremost environmentally friendly while being technically sound. The most practical range for the new promoter material of the instant invention lies within:

Tall Oil/Fatty Acid (2-15% Rosin typical): 70-95%

Linseed Oil: 2-25%

To which additional components may be added:

Frother (alcohol {x-OH}, Glycol or combination): 3-10%

Sodium Silicate: 0-10%

It should be apparent that the preferred composition lies in the range TOFA between 60-95% and linseed oil between 40-5%. 2-ethylhexane (2 EH) alcohol may be added to sensitize the composition to different sands. A coupling agent may be incorporated in the mixture to prevent stratification and sodium silicate may also be incorporated to reduce separation fines.

The composition accomplishes the aim which was to produce an environmentally friendly composition that could be disposed of without damaging the ground water. The composition is biodegradable. It had one unexpected result in that the composition actually performs as well (and better in some cases) than the promoter currently in use. Tests run by a competitor prove that the composition actually performs better that the current state of the art composition and confirms the findings by the inventor.

Thus, there has been discovered a new compound of matter or promoter for use in cleaning of industrial sand that results in good performance, consistent quality performance and is much more environmentally acceptable to Federal and State groundwater constraints and regulations. The constituents of the promoter can safely be blended together as a custom product (i.e. sensitized to particular sand) and has been found to be stable under storage conditions typically found in the mining industry.

I claim:

1. A composition of matter, for use as a promoter in flotation separation of carbonates from minerals comprising a mixture of Tall Oil/Fatty Acid, Linseed Oil and an additional alcohol 2-ethylhexane.

2. The composition of matter of claim 1 wherein the ranges of said individual constituents of the composition are:

Tall Oil/Fatty Acid between 50 and 95 percent,

Linseed Oil between 50 and 5 percent, and 2-ethylhexane between 1 and 5 percent.

3. A composition of matter, for use as a promoter in flotation separation of carbonates from minerals, comprising a mixture of Tall Oil/Fatty Acid and Linseed Oil wherein the ranges of said individual constituents of the composition are 50-95 percent Tall Oil/Fatty Acid and 50-5 percent Linseed Oil and wherein the rosin content of said Tall Oil/Fatty Acid ranges between 0 and 15 percent and wherein sodium silicate is added for suppression of the flotation of silica.

4. The composition of matter of claim 3 wherein 2-ethylheaxane alcohol is added within the range 1-5 percent.

5. The composition of matter of claim 3 to which a coupler is added for the suppression of stratification.

* * * * *